US009709944B2

(12) United States Patent
Takatsu et al.

(10) Patent No.: US 9,709,944 B2
(45) Date of Patent: Jul. 18, 2017

(54) IMAGE FORMING APPARATUS INCLUDING A DISCHARGE TRAY EXTENSION WITH ROLLERS

(71) Applicant: Konica Minolta, Inc., Chiyoda-ku, Tokyo (JP)

(72) Inventors: Hiroaki Takatsu, Nishio (JP); Naoya Nakayama, Toyokawa (JP); Tatsuya Eguchi, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/842,298

(22) Filed: Sep. 1, 2015

(65) Prior Publication Data

US 2016/0062297 A1 Mar. 3, 2016

(30) Foreign Application Priority Data

Sep. 3, 2014 (JP) ..... 2014-178972

(51) Int. Cl.
*B65H 31/20* (2006.01)
*G03G 15/00* (2006.01)
*B65H 31/30* (2006.01)

(52) U.S. Cl.
CPC ..... *G03G 15/6573* (2013.01); *B65H 31/20* (2013.01); *B65H 31/3054* (2013.01);
(Continued)

(58) Field of Classification Search
CPC .... G03G 2215/00421; B65H 2404/732; B65H 2405/111646; B65H 2405/1118;
(Continued)

(56) References Cited

U.S. PATENT DOCUMENTS 7,463,860 B2 * 12/2008 Nobe ..... B65H 31/20 399/114
2009/0238623 A1 * 9/2009 Kobayashi ..... B41J 11/007 399/405

FOREIGN PATENT DOCUMENTS

CN 101539737 A 9/2009
JP 2003095485 A 4/2003
(Continued)

OTHER PUBLICATIONS

Chinese First Office Action corresponding to Patent No. 201510552519.5; Mailing Date: Oct. 9, 2016, with English translation.

(Continued)

*Primary Examiner* — Justin Olamit
(74) *Attorney, Agent, or Firm* — Cantor Colburn LLP

(57) ABSTRACT

A sheet post-processing device for post-processing of a recording sheet ejected from an image forming device in an ejection direction, the sheet post-processing device including: a first tray on which the recording sheet is placed after ejection; a push-out member that pushes out, in a push-out direction different from the ejection direction, the recording sheet placed on the first tray; and a guide member adjacent to an ejection direction downstream end of the first tray, the guide member supporting a portion of the recording sheet that protrudes from the first tray in the ejection direction. The guide member includes a resistive force reduction unit that reduces a resistive force that occurs due to contact between the guide member and the recording sheet, the resistive force hindering the pushing out of the recording sheet when the push-out member pushes out the recording sheet.

12 Claims, 12 Drawing Sheets

(52) U.S. Cl.
CPC . *G03G 15/6582* (2013.01); *B65H 2404/1312* (2013.01); *B65H 2405/1118* (2013.01); *B65H 2405/11151* (2013.01); *B65H 2405/141* (2013.01); *B65H 2405/1412* (2013.01); *G03G 2215/00421* (2013.01)

(58) Field of Classification Search
CPC ..... B65H 2405/141; B65H 2405/1412; B65H 2405/142; B65H 2405/11151; B65H 2405/1117; B65H 2301/42266; B65H 31/20; B65H 31/3054; B65H 2404/1312
See application file for complete search history.

(56) References Cited

FOREIGN PATENT DOCUMENTS

| | | | |
|---|---|---|---|
| JP | 2004091184 | A | 3/2004 |
| JP | 2004155566 | A | 6/2004 |
| JP | 2006036437 | A | 2/2006 |
| JP | 2012131090 | A | 7/2012 |
| JP | 2012250844 | A | 12/2012 |

OTHER PUBLICATIONS

Japanese Notification of Reasons for Refusal corresponding to Application No. 2014-178972; Mailing Date: Oct. 4, 2016, with English translation.

* cited by examiner

Support member 900

Holding section 920

When resistive force is uniform (pushing at one point)

When resistive force is changed (pushing at one point)

IMAGE FORMING APPARATUS INCLUDING A DISCHARGE TRAY EXTENSION WITH ROLLERS

CROSS-REFERENCE TO RELATED APPLICATION

The present invention claims priority under 35 U.S.C. §119 to Japanese Application No. 2014-178972, filed Sep. 3, 2014, the entire content of which is incorporated herein by reference.

BACKGROUND OF THE INVENTION

Field of the Invention

The present invention relates to sheet post-processing devices and image forming devices, and specifically to techniques for stably ejecting a sheet that is long in a feed direction (FD).

Related Art

Among image forming devices such as photocopiers are in-body paper ejection types in which a printer is disposed in a space (hereafter, "in-body space") below a scanner and a recording sheet on which an image is formed by the printer is temporarily ejected into the in-body space.

Among in-body paper ejection types of image forming devices, a configuration may be considered in which recording sheets ejected into the in-body space are stacked into a recording sheet stack and pushed to a device front tray (hereafter, "front tray"). By adopting such a configuration, width of an image forming device can be decreased.

However, in a case in which an image forming device forms images by using recording sheets of various sizes, when a push-out member that is short in FD length is used to push a recording sheet stack that is long in FD length (hereafter, a "long sheet stack") to the front tray, it can occur that the long sheet stack rotates and cannot be cleanly pushed out to the front tray.

If the push-out member is made longer in response to such a problem, a high mechanical strength becomes required for the push-out member, leading to an increase in component cost. Further, an image forming device directed to space saving usually does not have much leeway in terms of space, and therefore location of the push-out member is limited and increasing length of the push-out member may not be possible.

Further, in order to drive a long push-out member a powerful drive source is required, but such a drive source has a problem of high power consumption. When a long push-out member is used, power consumption is also high when a recording sheet stack having a short length is pushed out, consuming unnecessary power in a way that is contrary to power saving requirements.

SUMMARY OF THE INVENTION

The present invention was achieved in view of the problems described above, and aims to provide a sheet post-processing device and an image forming device that can stably push out the long sheet stack without increasing length of the push-out member.

To achieve the above aim, a sheet post-processing device pertaining to the present invention is a sheet post-processing device for post-processing of a recording sheet ejected from an image forming device in an ejection direction, the sheet post-processing device comprising: a first tray on which the recording sheet is placed after ejection; a push-out member configured to push out, in a push-out direction different from the ejection direction, the recording sheet placed on the first tray; and a guide member disposed adjacent to an ejection direction downstream end of the first tray, the guide member being configured to support a portion of the recording sheet that protrudes from the first tray in the ejection direction, wherein the guide member includes a resistive force reduction unit configured to reduce a resistive force that occurs due to contact between the guide member and the recording sheet, the resistive force hindering the pushing out of the recording sheet when the push-out member pushes out the recording sheet.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF PREFERRED EMBODIMENTS

The following describes, with reference to the drawings, a sheet post-processing device and an image forming device according to embodiments of the present invention.

(1) Configuration of Image Forming Device

First, a configuration of an image forming device pertaining to the present embodiment is described below.

Figure 1:
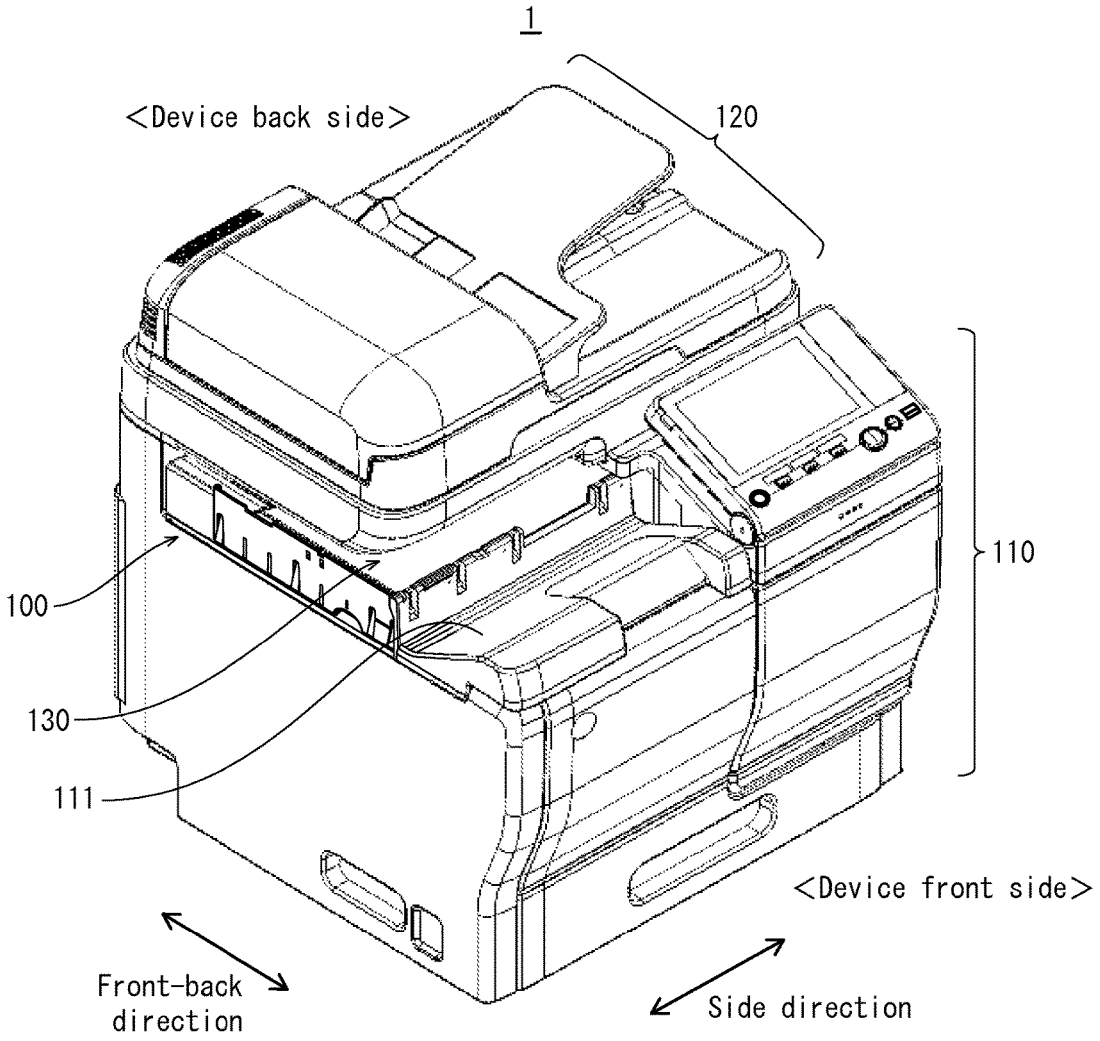
FIG. 1 is a perspective view illustrating major components of an image forming device pertaining to the present embodiment.

FIG. 1 is a perspective view illustrating major components of an image forming device pertaining to the present embodiment. As illustrated in FIG. 1, an image forming device 1 includes a sheet post-processing device 100, a printer 110, and a scanner 120. The scanner 120 reads a document and generates image data. The printer 110 forms an image on a recording sheet, based on one of image data generated by the scanner 120 and image data received from another device.

The image forming device 1 is an in-body paper ejection type and is provided with an in-body space 130 between the sheet post-processing device 100 and the scanner 120 for ejection of the recording sheet on which the printer 110 forms an image. The printer 110 includes a front tray 111 at a front side of the image forming device 1. A recording sheet ejected by the printer 110 onto the sheet post-processing device 100 in the in-body space 130 is, finally, pushed out onto the front tray 111.

According to this configuration, the recording sheet is ejected to the front side of the image forming device 1, and therefore width required by the image forming device 1 is less than width required by a configuration of the image forming device 1 that ejects the recording sheet to a side of the image forming device 1.

(2) Configuration of Sheet Post-Processing Device 100

The following describes configuration of the sheet post-processing device 100.

Figure 2:
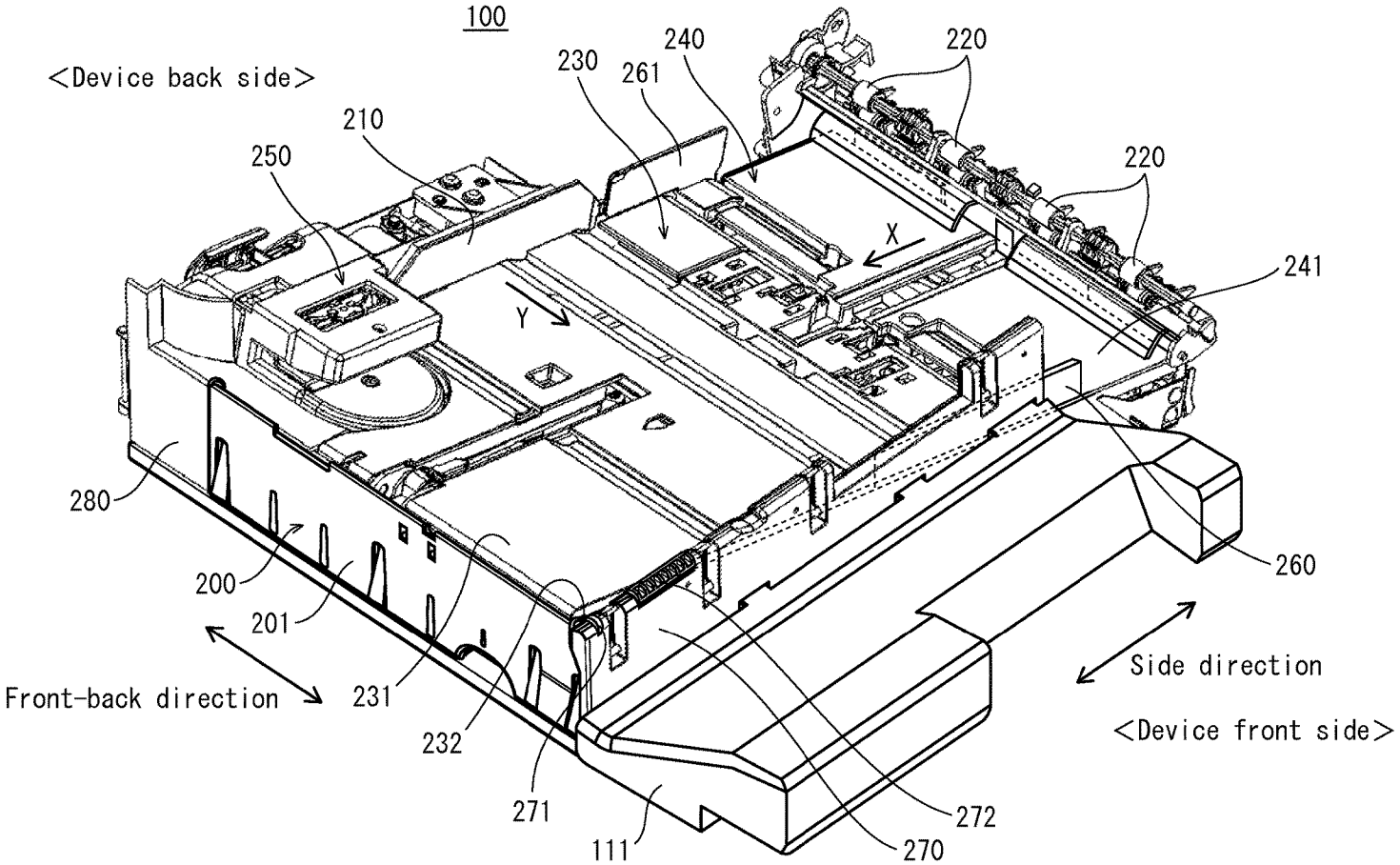
FIG. 2 is a perspective view illustrating major components of a sheet post-processing device 100.

FIG. 2 is a perspective view illustrating major components of the sheet post-processing device 100. As illustrated in FIG. 2, the sheet post-processing device 100 includes a pivot tray 230 and a fixed tray 240. Recording sheets ejected from the printer 110 in a feed direction (FD), indicated by an arrow X, are sequentially placed by ejection rollers 220 so as to span the fixed tray 240 and the pivot tray 230. Thus, a sheet stack is formed.

A cross direction (CD) alignment member 260 is provided at a device front side of the fixed tray 240 and a CD alignment member 261 is provided at a device back side of the fixed tray 240. A sheet stack placed spanning the fixed tray 240 and the pivot tray 230 is pushed to the CD alignment member 261 by movement of the CD alignment member 260 towards the device back side. Thus, the sheet stack is aligned in the CD.

The sheet stack aligned in the CD is transported in the FD, moved to be on the pivot tray 230 and not on the fixed tray 240. At this time, the sheet stack is also aligned in the FD. The sheet post-processing device 100 is provided with a stapler 250 and can staple the sheet stack aligned in both the CD and the FD according to instruction from a user.

The pivot tray 230 is supported by a body of the sheet post-processing device 100 so that the pivot tray 230 can pivot about a shaft 232 provided to an FD downstream end of the sheet post-processing device 100. The pivot tray 230 is inclined so that, when a recording sheet is ejected from the printer 110, a sheet placement surface 231 of the pivot tray 230 is on the same plane as a sheet placement surface 241 of the fixed tray 240. The pivot tray 230 can pivot according to a lift mechanism (not illustrated) that causes the sheet placement surface 231 to be horizontal. The sheet placement surface 231 in a horizontal state has a height substantially the same as an upper end of a vertical wall 270.

When the push-out member 210 moves towards the device front side (in a direction Y indicated by an arrow) while the sheet placement surface 231 is in a horizontal state, the sheet stack on the pivot tray 230 is pushed over the vertical wall 270 onto the front tray 111. The push-out member 210 is driven by a drive source (not illustrated) to be movable back and forth in the direction Y. Thus, ejection of the sheet stack is completed.

Rollers 271, 272 are provided to an upper end of an FD downstream side of the vertical wall 270. The rollers 271, 272 rotate as the sheet stack is pushed out. On the other hand, a roller is not provided to an upper end of an FD upstream side of the vertical wall 270, and therefore, when the sheet stack is pushed out, a friction force is generated between the sheet stack and the upper end of the FD upstream side of the vertical wall 270. This friction force is greater than a friction force generated between rotation axes and bearings of the rollers 271, 272 when rotated by the sheet stack.

The sheet post-processing device further includes a guide member 200. In FIG. 2, the guide member 200 is in a state of hanging from a shaft (not illustrated) and housed in a guide housing section 910 provided in an exterior of the sheet post-processing device 100 (see FIG. 9). In this case, the guide member 200 is compactly housed in the guide housing section 910 so that a sheet placement surface 201 of the guide member 200 is on the same plane as an external wall surface 280 adjacent to the guide housing section 910 of the sheet post-processing device 100.

(3) Guide Member 200

In the present embodiment, a largest size of a recording sheet upon which the image forming device 1 forms an image is legal paper (216 mm×365 mm), followed by A4 paper (210 mm×297 mm) A sheet stack that is at most A4 size is ejected as described above.

Figure 3:
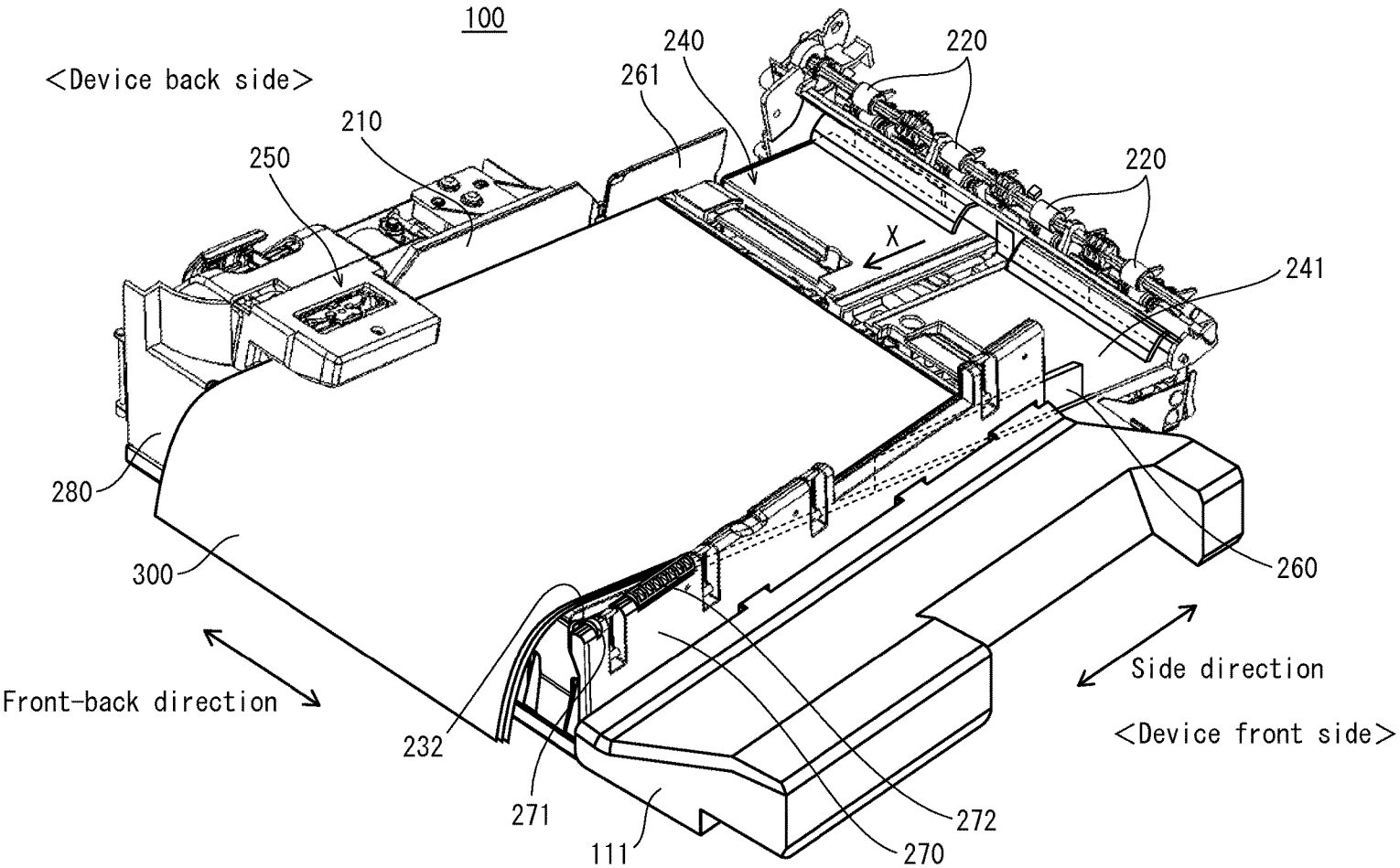
FIG. 3 illustrates a state in which a feed direction (FD) leading end of a long sheet stack 300 is hanging from a downstream end in the FD of a pivot tray 230.

However, FD length of legal paper is longer than A4 paper and when legal paper is transported in the FD so that it is completely off the fixed tray 240, an FD leading end of the legal paper passes beyond an FD downstream end of the pivot tray 230. Thus, as illustrated in FIG. 3, the FD leading end of the legal paper droops from the FD downstream end of the pivot tray 230.

Hereafter, a recording sheet of a size that protrudes from the pivot tray 230 in the FD is referred to as a "long sheet". In the present embodiment, North American "legal" paper and any recording sheet longer in the FD than legal paper correspond to a "long sheet".

According to conventional technology, in a state in which a leading end of a long sheet stack is drooping from the downstream end of the pivot tray 230, when the push-out member 210 is used to try and push out the long sheet stack to the front tray 111, the long sheet stack rotates and cannot be stably pushed out. Thus, according to the present embodiment, the guide member 200 is used when ejecting the long sheet stack.

The guide member 200 is a plate-like member pivotably supported by an FD downstream end of the body of the sheet post-processing device 100.

Figure 4:
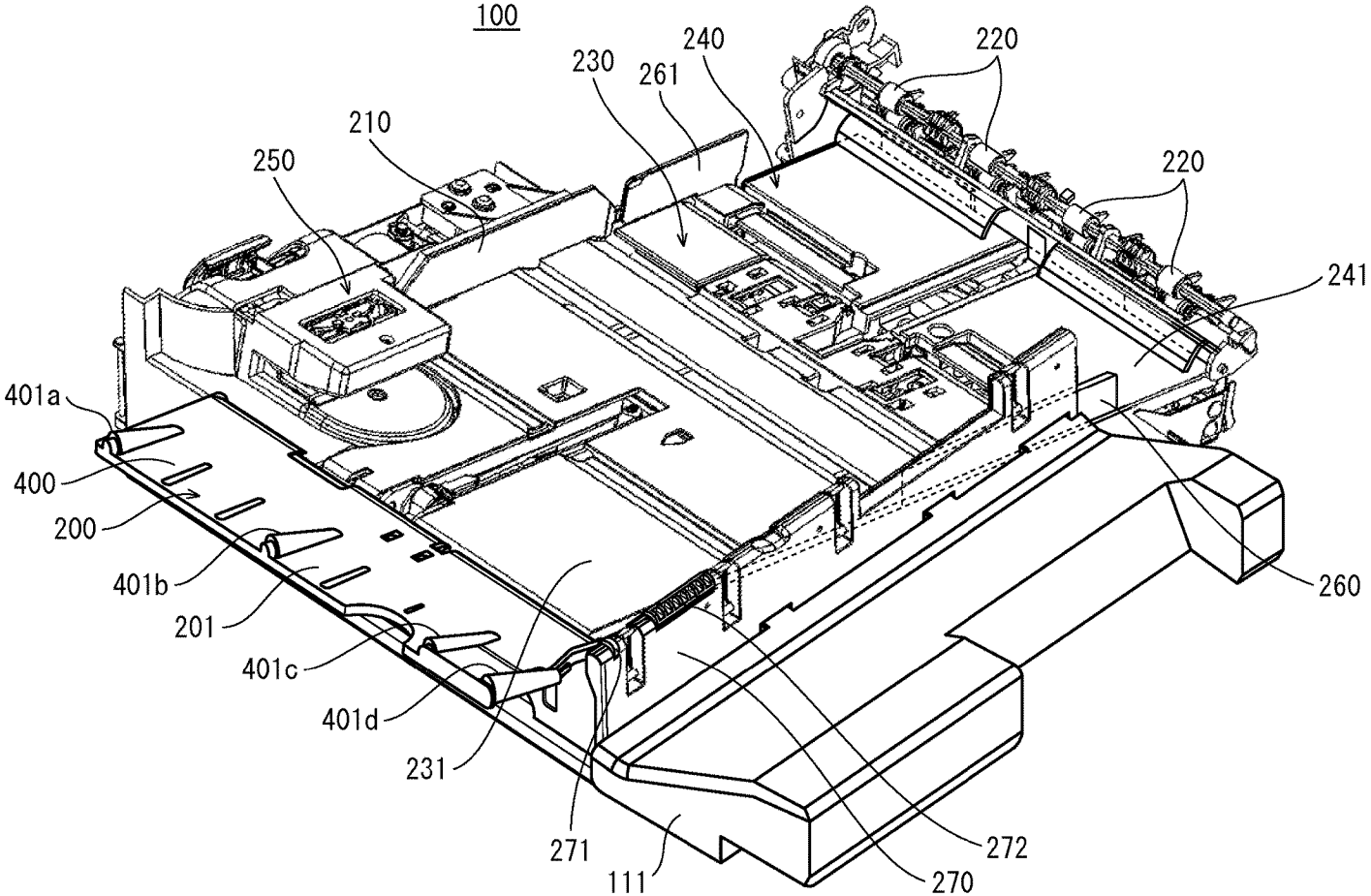
FIG. 4 is a perspective view illustrating the sheet post-processing device 100 with a guide member 200 in a fixed position.

Prior to the long sheet stack being ejected, a user of the image forming device pivots the guide member 200 until the sheet placement surface 201 of the guide member 200 is approximately on the same plane as the sheet placement surface 231 of the pivot tray 230 and the sheet placement surface of the fixed tray 240, causing the guide member 200 to be fixed in place (FIG. 4). When the guide member 200 is fixed in place, drooping of the leading end of the long sheet stack is prevented, because the leading end of the long sheet stack is placed on the guide member 200.

Figure 5:
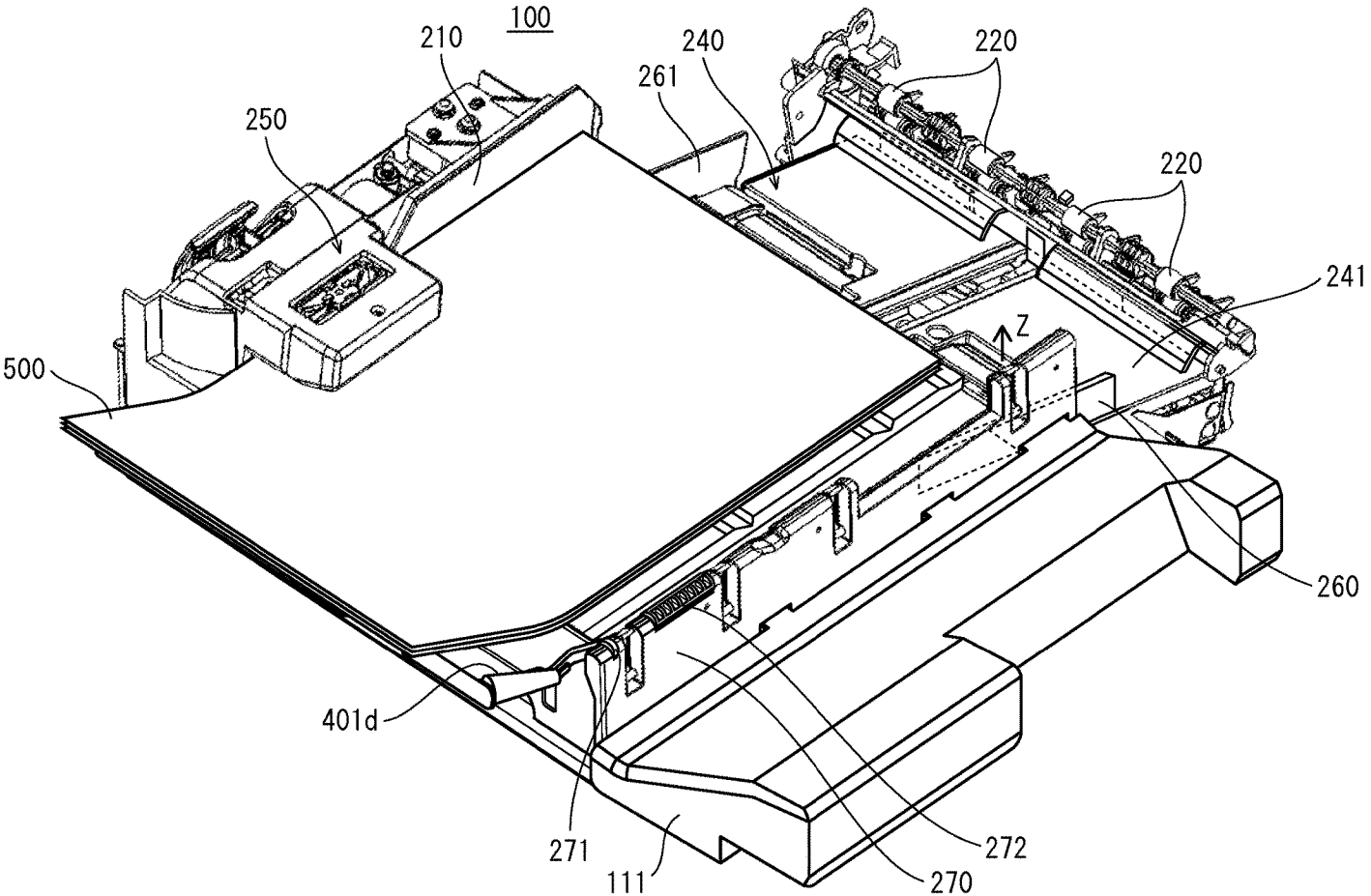
FIG. 5 is a perspective view illustrating the sheet post-processing device 100 immediately prior to pushing out of a long sheet stack 500.

Subsequently, as illustrated in FIG. 5, in a state in which the sheet placement surface 231 of the pivot tray 230 is horizontal, when the push-out member 210 moves towards the device front side, a sheet stack 500 on the pivot tray 230 is pushed out over the vertical wall 270 and onto the front tray 111.

(3-1) Configuration of Guide Member 200

The following describes the configuration of the guide member 200 in more detail.

Figure 6:
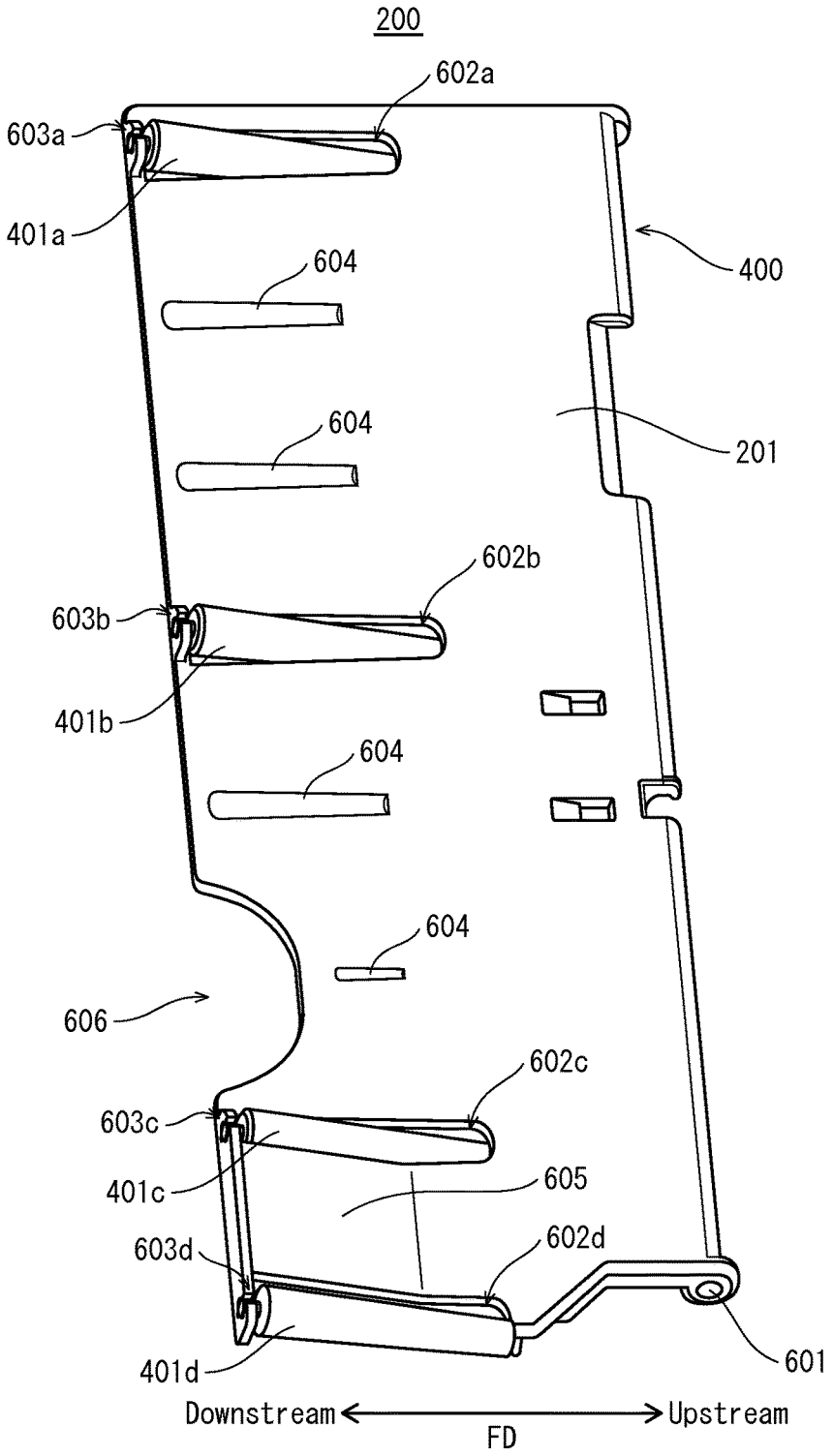
FIG. 6 is a view of an upper side of the guide member 200.

As illustrated in FIG. 6, the guide member 200 includes a main body 400 and rollers 401*a*, 401*b*, 401*c*, and 401*d*.

(3-2) Main Body 400

The main body 400 has the sheet placement surface 201 that is substantially flat.

As illustrated in FIG. 6, a bearing 601 is provided to an FD upstream end of the main body 400. The bearing 601 accepts a shaft (not illustrated) that protrudes from the FD upstream end of the body of the sheet post-processing device 100. Thus, the guide member 200 is pivotably supported by the sheet post-processing device 100.

Elongated through-holes 602*a*, 602*b*, 602*c* and a cutout portion 602*d* are provided to an FD downstream end of the main body 400. Each of the through-holes 602*a*, 602*b*, 602*c* widens in a direction from the FD upstream end towards the FD downstream end of the main body 400.

Bearings 603*a*, 603*b*, 603*c*, 603*d* are provided to the sheet placement surface 201 side of the main body 400 at FD downstream ends of the through-holes 602*a*, 602*b*, 602*c* and the cutout portion 602*d*, respectively. Further, bearings 701*a*, 701*b*, 701*c*, 701*d* are provided to a side of the main body 400 opposite the sheet placement surface 201 at FD upstream ends of the through-holes 602*a*, 602*b*, 602*c* and the cutout portion 602*d*, respectively (see FIG. 7). The bearings 603*a*, 603*b*, 603*c*, 603*d* are paired with the bearings 701*a*, 701*b*, 701*c*, 701*d*, respectively, and each pair supports a respective one of the rollers 401*a*, 401*b*, 401*c*, 401*d*. As a result, rotation axes of the rollers 401*a*, 401*b*, 401*c*, 401*d* are inclined with respect to the sheet placement surface 201.

Thus, the rollers 401*a*, 401*b*, 401*c*, 401*d* are provided to the FD downstream end of the main body 400, which is a position farthest from the push-out member 210. If magnitude of a resistive force acting on the long sheet stack is uniform, the farther a position is from the push-out member, the greater a rotational force applied to the long sheet stack becomes. Accordingly, providing the rollers 401*a*, 401*b*, 401*c*, 401*d* to the FD downstream end of the main body 400 effectively reduces a rotational force affecting the long sheet stack.

Grooves 604 (elongated concave portions) that are elongated in the FD are provided between the through-holes 602*a*, 602*b* and between the through-holes 602*b*, 602*c*. The grooves 604 reduce surface area of contact between the long sheet stack and the sheet placement surface 201, and therefore reduce a frictional force between the long sheet stack and the guide member 200 during pushing out of the long sheet stack.

Figure 8:
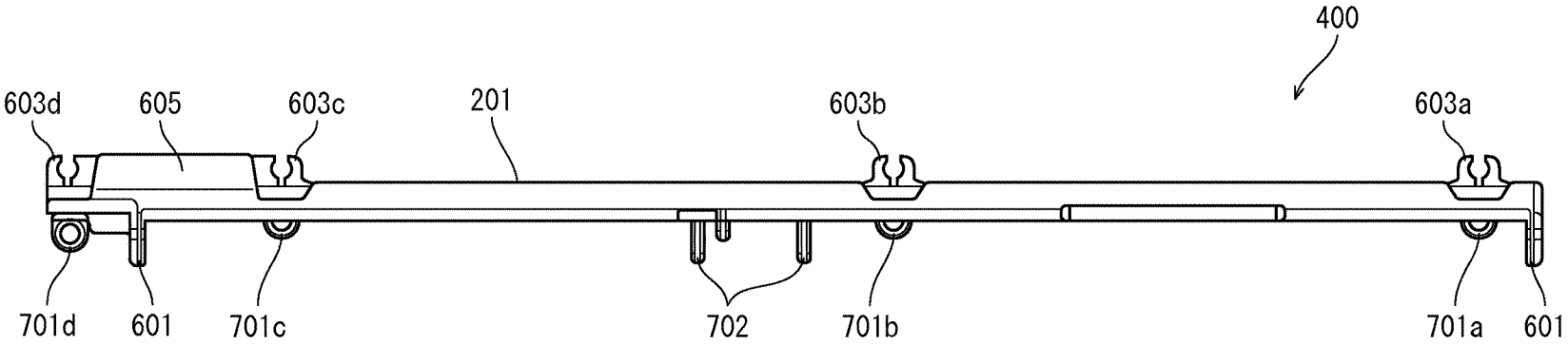
FIG. 8 is a side view of an FD downstream end of the guide member 200 in which rollers 401*a*, 401*b*, 401*c*, 401*d* are not illustrated.

A tapered surface 605 is provided between the roller 401*d* that is furthest downstream in a push-out direction of the long sheet stack and the roller 401*c* that is adjacent to the roller 401*d*, i.e. between the through-hole 602*c* and the cutout portion 602*d*, as illustrated in FIG. 6 and FIG. 8. The tapered surface 605 is an inclined surface that gets farther from the sheet placement surface 201 from an FD upstream end to an FD downstream end of the tapered surface 605.

Further, a distance from the sheet placement surface 201 of the tapered surface 605 is equivalent to or shorter than a distance from the sheet placement surface 201 of an uppermost portion of a cylindrical surface of the roller 401*a*. In other words, the tapered surface 605 is lower than the cylindrical surface of the roller 401*d* when viewed from the sheet placement surface 201. Accordingly, during pushing out, the long sheet stack that passes over the tapered surface 605 contacts the cylindrical surface of the roller 401*d* from above, and therefore resistive force applied to the long sheet stack when the long sheet stack drops to the front tray 111 is reduced.

The tapered surface 605 prevents a device front-side end of the long sheet stack from getting caught up under the roller 401*d* by guiding the device front-side end of the long sheet stack over the roller 401*d* when the long sheet stack is pushed out towards the front tray 111. In particular, the tapered surface 605 is effective when the device front-side end of the long sheet stack is curled towards the sheet placement surface 201.

Figure 9:
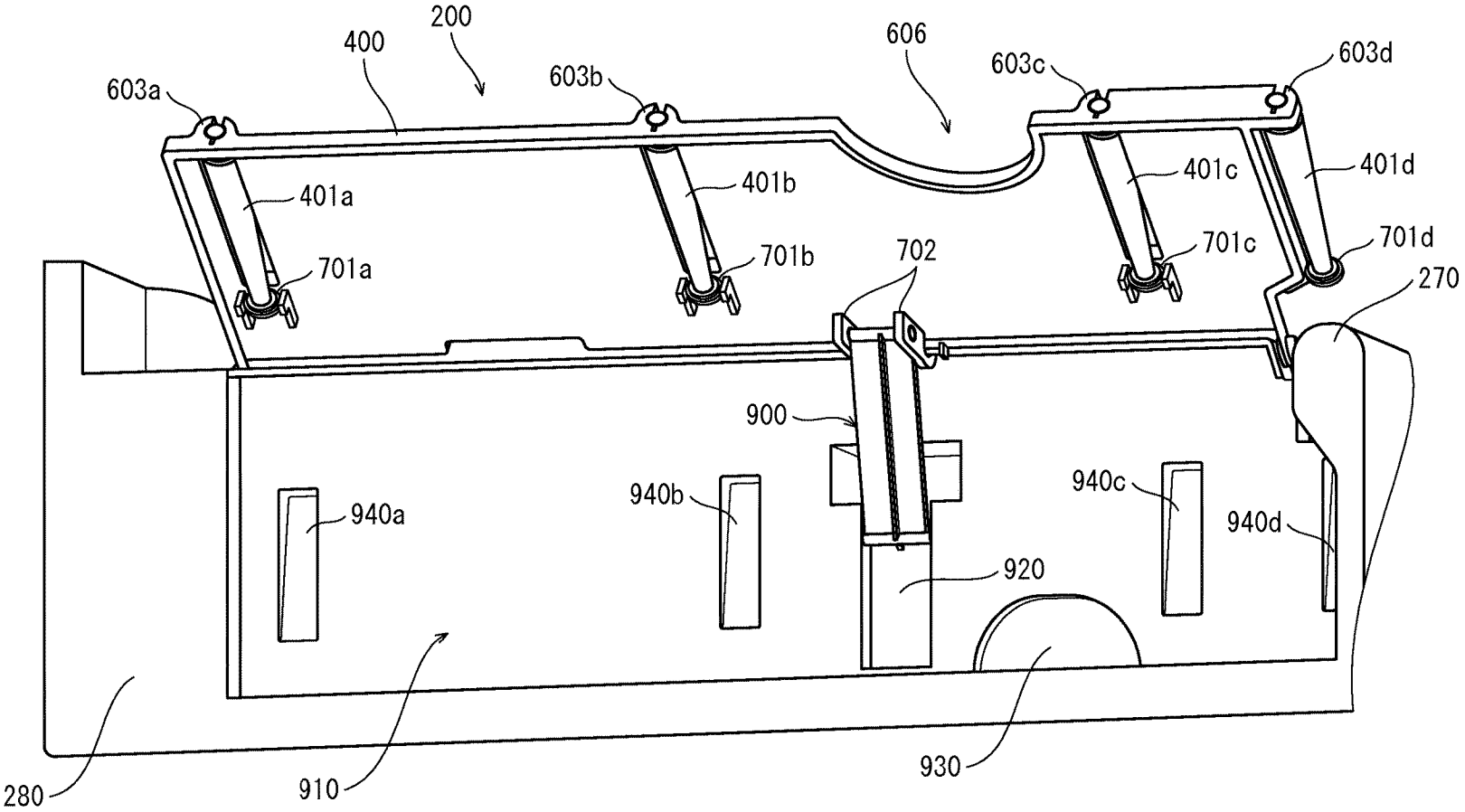
FIG. 9 is a perspective view illustrating a support mechanism supporting the guide member 200.

A cutout portion 606 is provided to the FD downstream end of the main body 400. Further, a concave portion 930, as illustrated in FIG. 9, is provided in the exterior of the sheet post-processing device 100 at a position corresponding to the cutout portion 606 when the guide member 200 is housed in the guide housing section 910. The concave portion 930 makes it easier for a user to hook a finger into the cutout portion 606.

As illustrated in FIG. 2, in a state in which the guide member 200 is housed in the guide housing section 910 of the sheet post-processing device 100, when a user hooks a finger into the cutout portion 606 the guide member 200 can easily be pulled out from its housed position, and can be pivoted to a fixed position illustrated in FIG. 4.

In the fixed position, the guide member 200 is supported by a support member 900 illustrated in FIG. 9. A bearing 702 is provided to a surface opposite the sheet placement surface 201 of the main body 400 and a shaft 1002 of the support member 900 is rotatably inserted into the bearing 702. The support member 900 supports the main body 400 in the bearing 702 (FIG. 10C).

When a user pivots the guide member 200 and the guide member 200 is fixed in the fixed position illustrated in FIG. 4, the sheet placement surface 201 of the guide member 200 and the sheet placement surface 231 of the pivot tray 230 are at substantially the same angle of inclination and are on substantially the same plane. In other words, the long sheet stack is placed on not only the sheet placement surface 231 but also the sheet placement surface 201, and therefore the leading end of the long sheet stack is supported and does not droop from the sheet placement surface 231 of the pivot tray 230. Note that as long as the leading edge of the long sheet stack does not droop, the leading edge of the long sheet stack may protrude from the guide member 200.

When the long sheet stack is pushed out, the sheet placement surface 231 of the pivot tray 230 changes orientation to be horizontal, but the sheet placement surface 201 of the guide member 200 maintains its inclined angle, as illustrated in FIG. 5. Accordingly, the long sheet stack bends and is deformed across the sheet placement surface 201 and the sheet placement surface 231. According to this deformation, a center of gravity of the long sheet stack is moved towards an FD upstream side of the long sheet stack. This movement of the center of gravity of the long sheet stack suppresses rotation of the long sheet stack when the long sheet stack is pushed out.

Further, when the long sheet stack is bent in this way, the long sheet stack becomes more resistant to bending of the long sheet stack in a direction perpendicular to the existing bend. Accordingly, the long sheet stack on the rollers 401*a*, 401*b*, 401*c*, 401*d* is unlikely to bend between the rollers, and therefore a contact surface area between the long sheet stack and the sheet placement surface 201 is decreased.

Frictional force between the long sheet stack and the sheet placement surface 201 does not occur, of course, in locations where the long sheet stack and the sheet placement surface 201 are not in contact. Accordingly, the incline of the sheet placement surface 201 of the guide member 200 with respect to the sheet placement surface 231 of the pivot tray 230 also serves to decrease frictional force between the long sheet stack and the sheet placement surface 201.

(3-3) Rollers 401*a*, 401*b*, 401*c*, 401*d*

Figure 7:
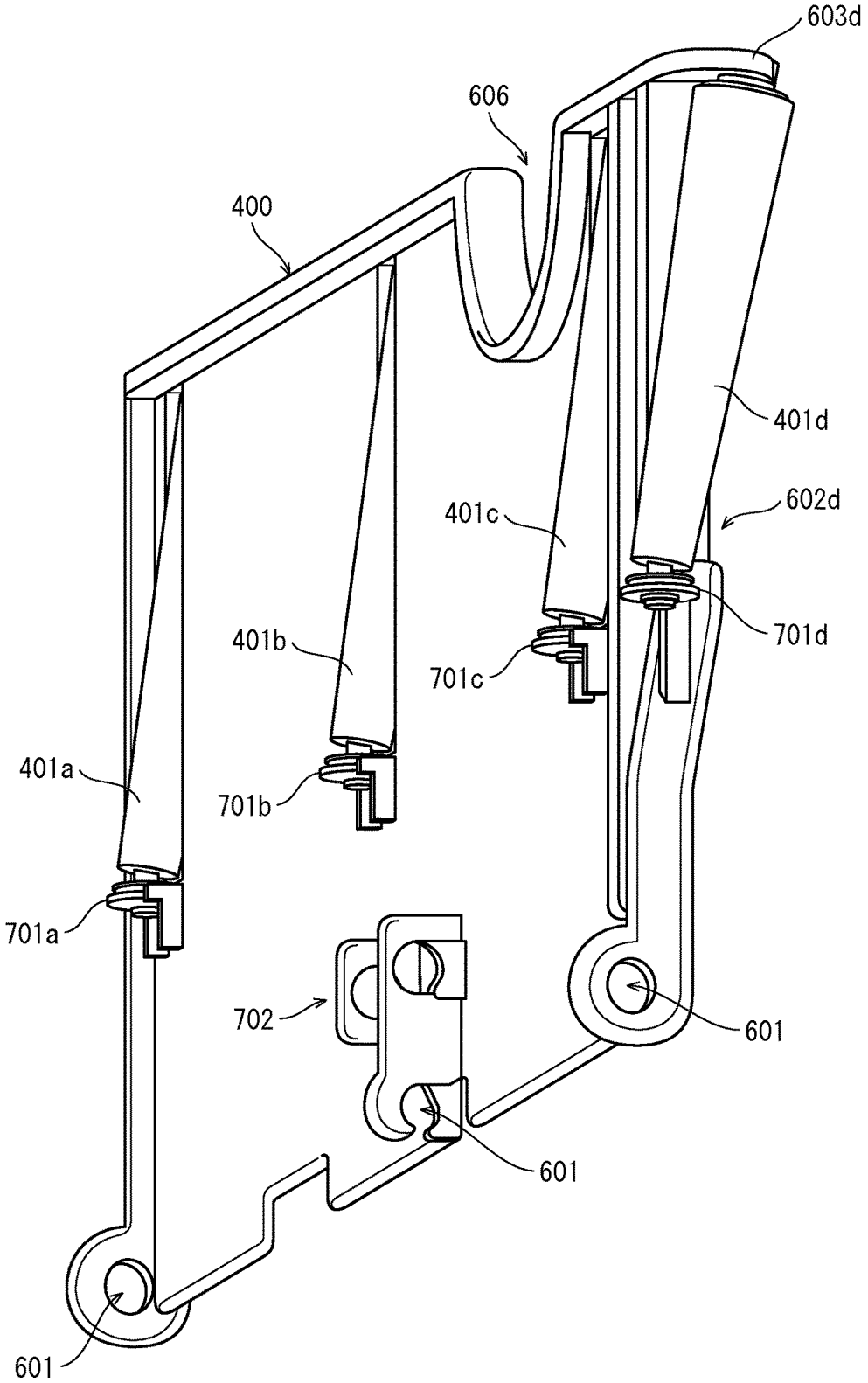
FIG. 7 is a view of a lower side of the guide member 200.

The rollers 401*a*, 401*b*, 401*c*, 401*d* are disposed in corresponding ones of the through-holes 602*a*, 602*b*, 602*c* and the cutout portion 602*d* in the FD downstream end of the main body 400, as illustrated in FIGS. 6 and 7. Each of the rollers 401*a*, 401*b*, 401*c*, 401*d* has a truncated cone shape whose diameter increases from an FD upstream end to an FD downstream end thereof.

As described above, the rollers 401*a*, 401*b*, 401*c*, 401*d* are rotatably supported by the bearings 603*a*, 603*b*, 603*c*, 603*d* and the bearings 701*a*, 701*b*, 701*c*, 701*d*. The rollers 401*a*, 401*b*, 401*c*, 401*d* are rotated by the pushing out of the long sheet stack.

Thus, during pushing out, a resistive force exerted on the long sheet stack from the pivot tray 230 comes from a static friction force and a kinetic friction force, while a resistive force exerted on the long sheet stack from the guide member 200 is only a rotational friction force. Accordingly, resistive force caused by the guide member 200 is less than resistive force caused by the pivot tray 230, preventing rotation of the long sheet stack when the long sheet stack is pushed out.

The FD upstream ends of the rollers 401*a*, 401*b*, 401*c*, 401*d* are lower than the sheet placement surface 201 and the FD downstream ends of the rollers 401*a*, 401*b*, 401*c*, 401*d* are higher than the sheet placement surface 201. The rotation axes of the rollers 401*a*, 401*b*, 401*c*, 401*d* are substantially identical to each other in terms of an incline angle relative to the sheet placement surface 201.

The rollers 401*a*, 401*b*, 401*c*, 401*d* have truncated cone shapes and therefore even when rotational surfaces thereof are inclined as described above, the rollers 401*a*, 401*b*, 401*c*, 401*d* do not protrude significantly from the surface opposite the sheet placement surface 201. Accordingly, the guide member 200 can be made thinner, and therefore the guide housing section 910 can be made shallow.

Further, because the FD upstream ends of the rollers 401*a*, 401*b*, 401*c*, 401*d* are lower than the sheet placement surface 201, the leading end of the long sheet stack transported in the FD is transported onto the guide member 200 without interference from the FD upstream ends of the rollers 401*a*, 401*b*, 401*c*, 401*d*.

The roller 401*a* is disposed in a location at which a device back side end of the long sheet stack is placed after transport of the long sheet stack in the ED is completed and before pushing out by the push-out member 210 starts. The roller 401*b* is disposed in a location at which a center portion of the long sheet stack in the CD is placed at this time. The roller 401*c* is disposed in a location at which a device front-side end of the long sheet stack is placed at this time. The roller 401*d* is disposed so that, in plan view, the rotation axis of the roller 401*d* and the rotation axes of the rollers 271, 272 are on a straight line.

The rollers 271, 272 are rotated along with the roller 401*d* by the pushing out of the long sheet stack. During this rotation, a resistive force inhibiting pushing out of the long sheet stack is generated by friction between the rotation axes of the rollers 271, 272, 401*d* and their respective bearings. On the other hand, a roller is not provided to the upper end of the FD upstream side of the vertical wall 270, and therefore, when the long sheet stack is pushed out, a friction force is generated between the sheet stack and the upper end of the FD upstream side of the vertical wall 270. The resistive force generated by the rollers 271, 272, 401*d* is sufficiently small in comparison with the friction force between the vertical wall 270 and the long sheet stack during pushing out of the long sheet stack.

Thus, even when the push-out member 210 pushes out the long sheet stack from a position upstream in the FD, the resistive force exerted on the long sheet stack from the rollers 271, 272, 401*d* is small, and therefore the long sheet stack can be stably pushed out to the front tray 111 without rotating.

(3-4) Support Member 900

Figure 10A:
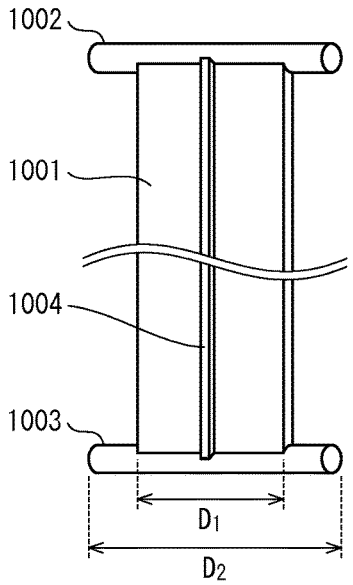
FIG. 10A illustrates configuration of a support member 900.
Figure 10B:
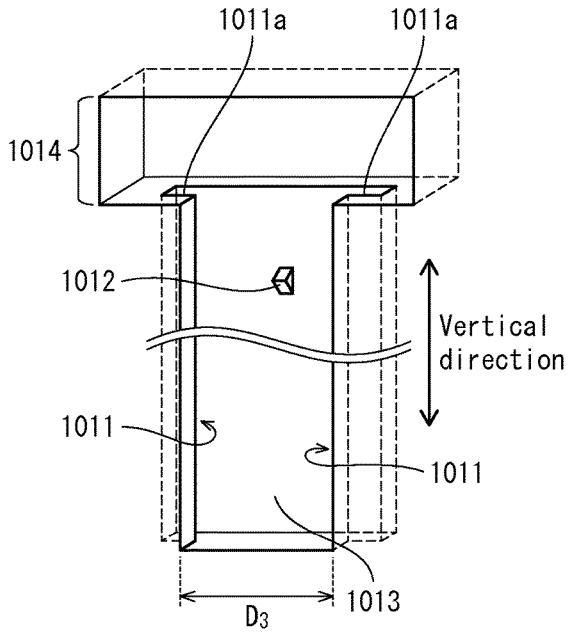
FIG. 10B illustrates configuration of a holding section 920.
Figure 10C:
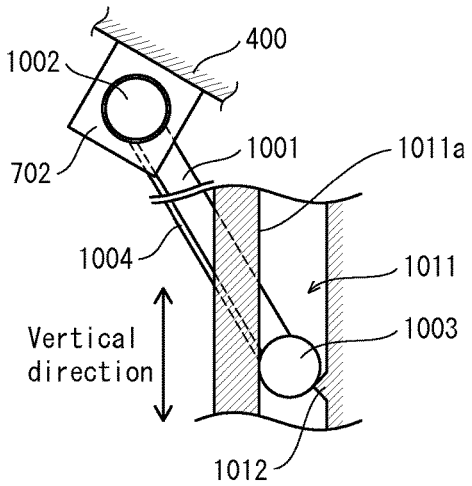
FIG. 10C illustrates a state in which the support member 900 and the holding section 920 are engaged.

FIGS. 10A to 10C illustrate configuration of the support member 900 and a holding section 920.

As illustrated in FIG. 10A, the support member 900 has a strut 1001 having an elongated flat shape and shafts 1002, 1003 at opposite ends of the strut 1001 in a longitudinal direction of the strut 1001. The shafts 1002, 1003 (width D2) are wider than the strut 1001 (width D1). As illustrated in FIG. 10C, both ends of the shaft 1002 are rotatably supported by the bearing 702 of the main body 400.

As illustrated in FIG. 9, the holding portion 920 is provided to the guide housing section 910 of the sheet post-processing device 100 and holds both ends of the shaft 1003 of the support member 900 so that the shaft 1003 is slidable up and down. As illustrated in FIG. 10B, guide grooves 1011 are provided along both sides of the holding portion 920 in the longitudinal direction thereof, the guide grooves guiding the both ends of the shaft 1003 in a vertical direction. Further, a portion between the guide grooves 1011 of the holding portion 920 is an opening 1013.

An opening width D3 of the opening 1013 is less than the width D2 of the shaft 1003, and greater than the width D1 of the strut 1001. Thus, D1 is less than D3, and D3 is less than D2. According to this configuration, the both ends of the shaft 1003 are inserted into the guide grooves 1011 and the support member 900 is held by the holding section 920.

A protrusion 1012 protrudes into the holding section 920, as illustrated in FIG. 10B. As illustrated in FIG. 10C, when the guide member 200 is in the fixed position the guide member 200 is supported by the shaft 1003 being in contact with the protrusion 1012 from above and in contact with inner wall surfaces 1011 a that partially define the guide grooves 1011.

Further, when a force in the vertical direction is applied to the guide member 200, the shaft 1003 is pushed against the protrusion 1012 and elastically deformed. In this state, the inner wall surfaces 1011*a* against which the shaft 1003 is pushed also elastically deform. When a greater force is applied to the guide member 200, the shaft 1003 and the inner wall surfaces 1011*a* further elastically deform, and the shaft 1003 passes by the protrusion 1012 to move in the vertical direction.

As illustrated in FIG. 10B, a shaft housing portion 1014 is provided to an upper end of the holding portion 920. When the guide member 200 is not being used, the shaft 1002 of the support member 900 and the bearing 702 of the main body 400 are housed in the shaft housing portion 1014.

(4) Rotation Prevention When Long Sheet Stack is Pushed Out

The following is a description of how rotation of the long sheet stack is prevented when the long sheet stack is pushed out, according to the present embodiment.

(4-1) How a Sheet Stack is Rotated

First, a description of how a sheet stack is rotated.

A situation is considered in which a position upstream in the FD of a center position of a sheet stack is pushed out.

Figure 11A:
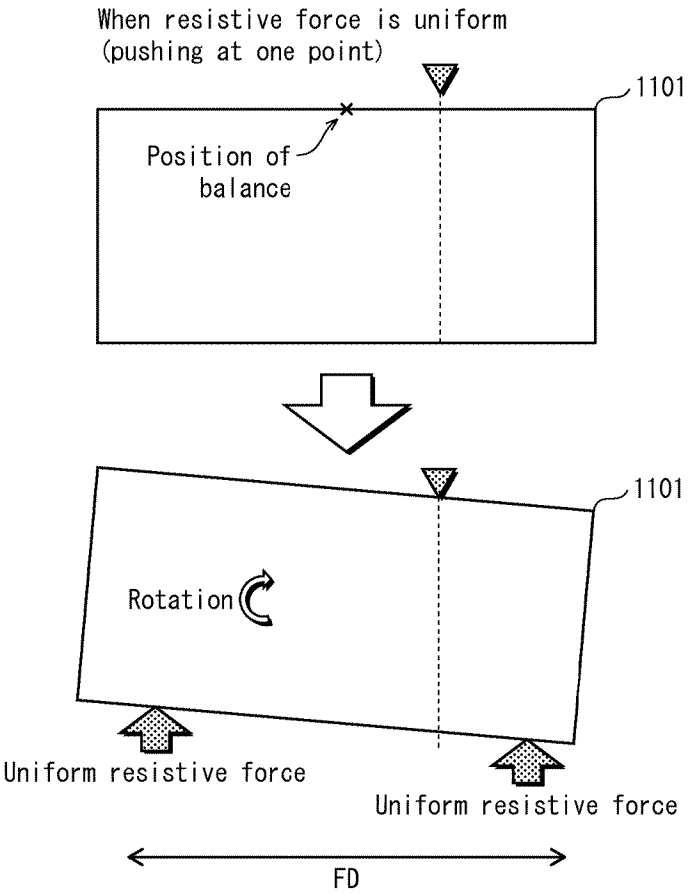
FIG. 11A illustrates that when a uniform resistive force acts on a sheet stack in the FD, the sheet stack rotates when pushed at a point that is not a point of balance.

When pushing out a sheet stack, in a case in which a resistive force (friction) acting on the sheet stack is uniform in the FD, a center position of a sheet stack 1101 in the FD matches a position of balance of the resistive force, as illustrated in FIG. 11A. Thus, when the sheet stack 1101 is pushed out by a point upstream of the position of balance in the FD, the sheet stack 1101 rotates.

Figure 11B:
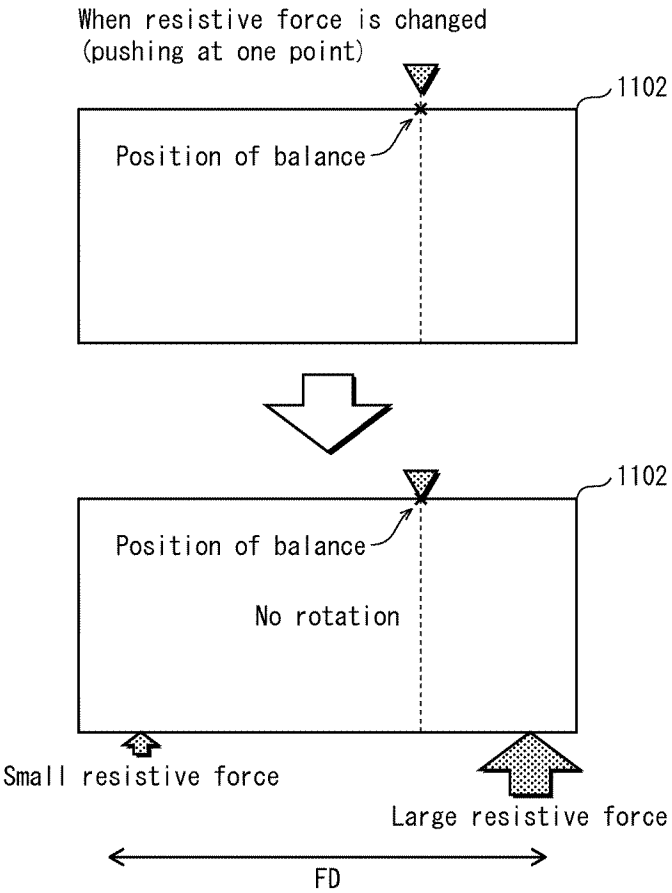
FIG. 11B illustrates that when a resistive force acting on the sheet stack downstream in the FD is less than a resistive force acting on the sheet stack upstream in the FD, the sheet stack does not rotate when pushed at a point that is a point of balance.

On the other hand, in a case in which resistive force acting on a sheet stack is smaller downstream in the FD than upstream in the FD, a position of balance of the resistive force is upstream of a center position of a sheet stack 1102, as illustrated in FIG. 11B. Thus, when the sheet stack 1102 is pushed out, the point at which the sheet stack 1102 is pushed and the resistive force exerted on the sheet stack 1102 balance at the position of balance, and therefore the sheet stack 1102 is pushed out without being rotated.

Figure 12A:
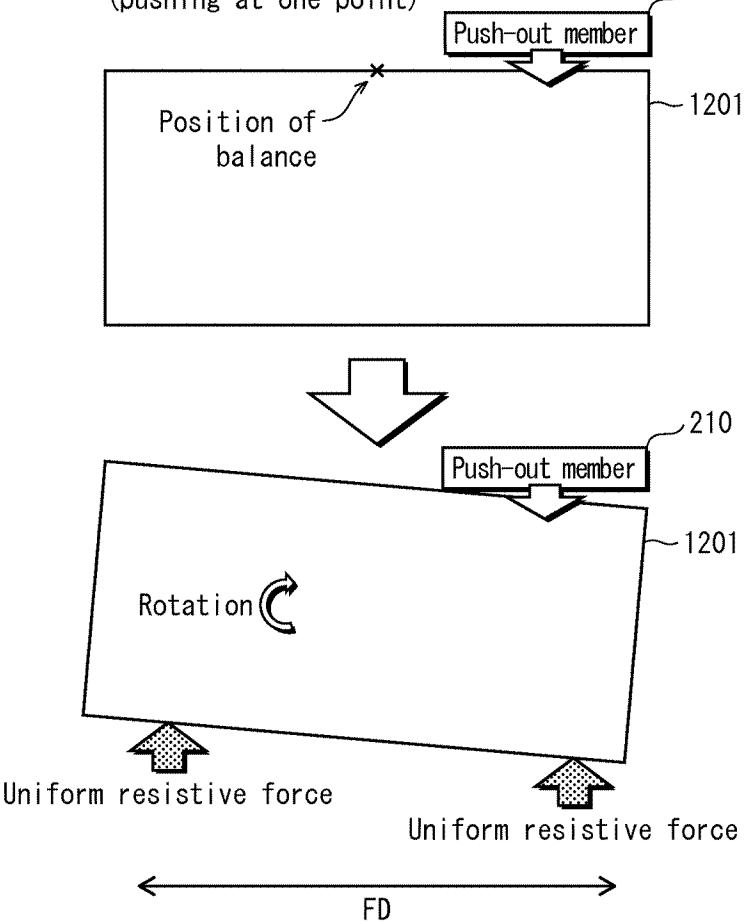
FIG. 12A illustrates that when a uniform resistive force acts on the sheet stack in the FD, the sheet stack rotates when a push-out member 210 pushes at a point that is not a point of balance.

Whether or not a sheet stack rotates when being pushed out can be considered in the same way when the sheet stack is pushed out by the push-out member 210 instead of a single point. As illustrated in FIG. 12A, when resistive force exerted on a sheet stack is uniform, a contact range between the push-out member 210 and a sheet stack 1201 is not aligned with the position of balance and the sheet stack 1201 rotates.

Figure 12B:
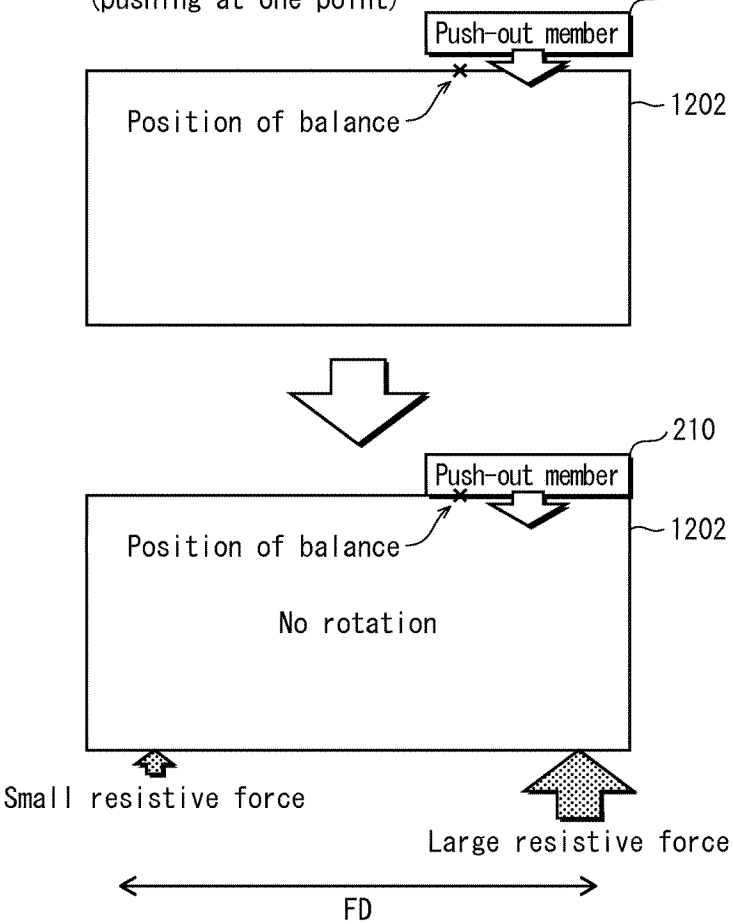
FIG. 12B illustrates that when a resistive force acting on the sheet stack downstream in the FD is less than a resistive force acting on the sheet stack upstream in the FD, the sheet stack does not rotate when the push-out member 210 pushes at a point that is a point of balance.

Further, when resistive force acting on a sheet stack is less downstream in the ED than upstream in the FD, the position of balance is moved upstream in the FD, and when the position of balance is within the contact range between the push-out member 210 and a sheet stack 1202, the sheet stack 1202 can be pushed out to the front tray 111 without being rotated, as illustrated in FIG. 12B.

(4-2) Rotation Prevention with Respect to Long Sheet Stack

According to the present embodiment, during pushing out, more resistive force is exerted on the long sheet stack from the pivot tray 230 than from the guide member 200. Further, more resistive force (friction) is exerted on the long sheet stack from the upper end of the vertical wall 270 than from the rollers 271, 272, 401*d*.

Resistive force exerted on the long sheet stack from the pivot tray 230 is friction between the long sheet stack and the sheet placement surface 231. Resistive force exerted on the long sheet stack from the guide member 200 is friction between the long sheet stack and the sheet placement surface 201 and friction between the rotation axes of the rollers 401*a*, 401*b*, 401*c* and their respective bearings. Resistive force exerted on the long sheet stack from the upper end of the vertical wall 270 is friction, and resistive force exerted on the long sheet stack from the rollers 271, 272, 401*d* is caused by friction between the rotation axes of the rollers 271, 272, 401*d* and their respective bearings.

In a sheet post-processing device not provided with the guide member 200, when the FD upstream end of the long sheet stack 300 droops as illustrated in FIG. 3, a load of the drooping portion is concentrated on the FD downstream end of the pivot tray 230. Thus, a normal force exerted on the long sheet stack 300 from the FD downstream end of the pivot tray 230 is large, and therefore friction generated between the long sheet stack 300 and the FD downstream end of the pivot tray 230 is increased.

This increased friction acts on the FD downstream end of the long sheet stack 300, and therefore when the long sheet stack 300 is pushed out by the push-out member 210, the long sheet stack 300 rotates and ejection to the front tray 111 is unstable.

On the other hand, in the present embodiment, the FD downstream end of the long sheet stack is on the guide member 200, the FD downstream end does not droop, and accordingly an increase in friction due to concentration of the load is prevented. Further, resistive force exerted on the long sheet stack from the rollers 401*a*, 401*b*, 401*c*, 401*d* of the guide member 200 is less than friction between the long sheet stack and the sheet placement surface 201 in a case in which the rollers 401*a*, 401*b*, 401*c*, 401*d* are not present, and therefore rotation of the long sheet stack is prevented.

Further, according to the incline of the guide member 200, rotation of the long sheet stack during pushing out is prevented by the center of gravity of the long sheet stack being moved upstream in the FD. Further, above the vertical wall 270, resistive force exerted on the long sheet stack is less from the rollers 271, 272, 401*d* than from the upper end of the vertical wall 270, and therefore resistive force acting on the FD downstream end of the long sheet stack is less than resistive force acting on the FD upstream end of the long sheet stack.

Thus, according to the present embodiment, the long sheet stack can be stably ejected onto the front tray 111 without being caused to rotate, in the same way as a small-sized recording sheet stack.

(5) Modifications

The description above is based on an embodiment of the present invention, but the present invention is of course not limited to the embodiment above and modifications such as those described below may be implemented.

(i) In the embodiment above, resistive force exerted on the long sheet stack from the guide member 200 is decreased by provision of the rollers 401*a*, 401*b*, 401*c*, 401*d* to the guide member 200. The present invention is of course not limited in this way, and resistive force may be decreased by means other than the rollers 401*a*, 401*b*, 401*c*, 401*d*. For example, by making the sheet placement surface 201 uneven, the contact surface area between the long sheet stack and the sheet placement surface 201 may be decreased, decreasing friction and thereby decreasing resistive force exerted on the long sheet stack. The sheet placement surface 201 may be coated with a low-friction layer to reduce friction.

(ii) In the embodiment above, the rollers 401*a*, 401*b*, 401*c*, 401*d* each have a truncated cone shape. The present invention is of course not limited in this way and even if the rollers 401, 401*b*, 401*c*, 401*d* each have a cylindrical shape the same effect can be obtained. Further, the number of rollers is not limited to four, and five or more rollers may be provided. In order to decrease the contact surface area between the long sheet stack and the sheet placement surface 201, it is preferable that the number of rollers increases as width of the long sheet stack in the CD increases.

(iii) In the embodiment above, the image forming device 1 in which the scanner 120 is provided above the printer 110 is described as an example. The present invention is of course not limited in this way, and instead of the scanner 120 or in addition to the scanner 120 a device other than the scanner 120 may be provided above the printer 110.

In a case in which a configuration is adopted wherein a recording sheet on which an image is formed is ejected onto the front tray 111, in order to reduce width of the image forming device provided with a device above the printer 110, the effect of a reduction of width of the image forming device can be obtained by application of the present invention regardless of the device provided above the printer 110.

(iv) In the embodiment above, a recording sheet no larger than A4 size fits within the sheet placement surface 231 of the pivot tray 230 and a recording sheet such as legal paper that exceeds A4 size protrudes from the sheet placement surface 231. The present invention is of course not limited in this way, and regardless of size of the sheet placement surface 231, particularly in FD length, the effects of the present invention are achieved.

Regardless of the FD length of the sheet placement surface 231, when the long sheet stack is pushed out by the push-out member 210 from a state in which the FD downstream end of the long sheet stack is on the guide member 200, the long sheet stack can be pushed out onto the front tray 111 without causing the long sheet stack to rotate.

Although not explicitly described in the embodiment above, a paper feed tray may be provided below the printer 110 for a recording sheet of a size that fits within the sheet placement surface 231 of the pivot tray 230, and paper may be fed from the paper feed tray. Further, manual sheet feeding may be performed for a long sheet.

(v) In the embodiment above, the rollers 401*a*, 401*b*, 401*c* are within the through-holes 602*a*, 602*b*, 602*c*. The present invention is of course not limited in this way, and instead of the through-holes 602*a*, 602*b*, 602*c* the guide member 200 may be provided with grooves and the rollers 401*a*, 401*b*, 401*c* housed in the grooves.

(vi) In the embodiment above, the pivot tray becomes horizontal when the long sheet stack is pushed out. The present invention is of course not limited in this way, and even in a case in which the pivot tray 230 is not horizontal when the long sheet stack is pushed out, as long as an angle of inclination of the guide member 200 is greater than an angle of inclination of the pivot tray 230 with respect to the horizontal, the effects of the present invention can be obtained.

(6) Summary

As described above, a sheet post-processing device pertaining to the present invention is a sheet post-processing device for post-processing of a recording sheet ejected from an image forming device in an ejection direction, the sheet post-processing device comprising: a first tray on which the recording sheet is placed after ejection; a push-out member configured to push out, in a push-out direction different from the ejection direction, the recording sheet placed on the first tray; and a guide member disposed adjacent to an ejection direction downstream end of the first tray, the guide member being configured to support a portion of the recording sheet that protrudes from the first tray in the ejection direction, wherein the guide member includes a resistive force reduction unit configured to reduce a resistive force that occurs due to contact between the guide member and the recording sheet, the resistive force hindering the pushing out of the recording sheet when the push-out member pushes out the recording sheet. According to this configuration, the resistive force hindering the pushing out of the recording sheet caused by contact with the recording sheet is less at the guide member than at the first tray, and therefore rotation of the recording sheet caused by resistive force when pushing out the recording sheet is prevented.

The sheet post-processing device may be configured so that the guide member has a main body having a sheet placement surface on which the recording sheet is placed, the resistive force reduction unit includes a roller rotatably attached to the main body and rotatable in the push-out direction, and a portion of a rotating surface of the roller protrudes from the sheet placement surface.

Further, the sheet post-processing device may be configured so that the roller is disposed at an ejection direction downstream end of the main body.

Further, the sheet post-processing device may be configured so that an ejection direction upstream end of the roller does not protrude from the sheet placement surface.

Further, the sheet post-processing device may be configured so that the roller has a truncated cone shape, diameter of the truncated cone shape increasing downstream in the ejection direction.

Further, the sheet post-processing device may be configured so that one roller included in the resistive force reduction unit is disposed at a push-out direction downstream end of the main body.

Further, the sheet post-processing device may be configured so that the roller is provided in a plurality, a guide portion is provided to the sheet placement surface of the main body between one of the rollers disposed at a push-out direction downstream end of the main body and an adjacent one of the rollers upstream in the push-out direction, the guide portion guiding a push-out direction downstream end of the recording sheet over the roller disposed at the push-out direction downstream end of the main body, the guide portion is tapered so that a distance between an upper surface of the guide portion and the sheet placement surface increases downstream in the ejection direction, and the distance of the upper surface of the guide portion from the sheet placement surface is equivalent to or less than distance of an uppermost surface of the roller disposed at the push-out direction downstream end of the main body from the sheet placement surface.

Further, the sheet post-processing device may be configured so that the guide member is, during the pushing out operation, inclined so that an ejection direction downstream end of the guide member is higher than an ejection direction upstream end of the guide member, and with respect to a horizontal plane, the guide member is more inclined than the first tray.

Further, the sheet post-processing device may be configured so that an exterior member is provided to an exterior of the sheet post-processing device, and the guide member is pivotally supported to be rotatable around a pivot, relative to the first tray, and the exterior member is provided with a housing recess that houses the guide member when the guide member is in a state of hanging from the pivot.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A sheet post-processing device for post-processing of a recording sheet ejected from an image forming device in an ejection direction, the sheet post-processing device comprising:

a first tray on which the recording sheet is placed after ejection;

a push-out member configured to push out, in a push-out direction different from the ejection direction, the recording sheet placed on the first tray; and a guide member disposed adjacent to an ejection direction downstream end of the first tray, the guide member being configured to support a portion of the recording sheet that protrudes from the first tray in the ejection direction, wherein the guide member includes a resistive force reduction unit configured to reduce a resistive force that occurs due to contact between the guide member and the recording sheet, the resistive force hindering the pushing out of the recording sheet when the push-out member pushes out the recording sheet, wherein the guide member has a main body having a sheet placement surface on which the recording sheet is placed, the resistive force reduction unit includes a roller rotatably attached to the main body and rotatable in the push-out direction, a portion of a rotating surface of the roller protrudes from the sheet placement surface, the guide member is movable to a position at which the guide member supports a portion of the recording sheet that protrudes from the first tray in the ejection direction and to a position at which the guide member does not support a portion of the recording sheet that protrudes from the first tray in the ejection direction, and the resistive force reduction unit reduces the resistive force at a position where the portion of the recording sheet that protrudes from the first tray in the ejection direction is supported.

2. The sheet post-processing device of claim 1, wherein the roller is disposed at an ejection direction downstream end of the main body.

3. The sheet post-processing device of claim 1, wherein an ejection direction upstream end of the roller does not protrude from the sheet placement surface.

4. The sheet post-processing device of claim 1, wherein the roller has a truncated cone shape, diameter of the truncated cone shape increasing downstream in the ejection direction.

5. The sheet post-processing device of claim 1, wherein one roller included in the resistive force reduction unit is disposed at a push-out direction downstream end of the main body.

6. The sheet post-processing device of claim 1, wherein the roller is provided in a plurality, a guide portion is provided on the sheet placement surface of the main body between one of the rollers disposed at a push-out direction downstream end of the main body and an adjacent one of the rollers upstream in the push-out direction, the guide portion guiding a push-out direction downstream end of the recording sheet over the roller disposed at the push-out direction downstream end of the main body, the guide portion is tapered so that a distance between an upper surface of the guide portion and the sheet placement surface increases downstream in the ejection direction, and the distance of the upper surface of the guide portion from the sheet placement surface is equivalent to or less than a distance of an uppermost surface of the roller disposed at the push-out direction downstream end of the main body from the sheet placement surface.

7. The sheet post-processing device of claim 1, wherein the guide member is, during the pushing out operation, inclined so that an ejection direction downstream end of the guide member is higher than an ejection direction upstream end of the guide member, and with respect to a horizontal plane, the guide member is more inclined than the first tray.

8. The sheet post-processing device of claim 1, wherein an exterior member is provided to an exterior of the sheet post-processing device, and the guide member is pivotally supported to be rotatable around a pivot, relative to the first tray, and the exterior member is provided with a housing recess that houses the guide member when the guide member is in a state of hanging from the pivot.

9. An image forming device including a sheet post-processing device for post-processing of a recording sheet ejected by the image forming device, the sheet post-processing device comprising:

a first tray on which the recording sheet is placed after ejection;

a push-out member configured to push out, in a push-out direction different from an ejection direction, the recording sheet placed on the first tray; and a guide member disposed adjacent to an ejection direction downstream end of the first tray, the guide member being configured to support a portion of the recording sheet that protrudes from the first tray in the ejection direction, wherein the guide member includes a resistive force reduction unit configured to reduce a resistive force that occurs due to contact between the guide member and the recording sheet, the resistive force hindering the pushing out of the recording sheet when the push-out member pushes out the recording sheet, wherein the guide member has a main body having a sheet placement surface on which the recording sheet is placed, the resistive force reduction unit includes a roller rotatably attached to the main body and rotatable in the push-out direction, a portion of a rotating surface of the roller protrudes from the sheet placement surface, the guide member is movable to a position at which the guide member supports a portion of the recording sheet that protrudes from the first tray in the ejection direction and to a position at which the guide member does not support a portion of the recording sheet that protrudes from the first tray in the ejection direction, and the resistive force reduction unit reduces the resistive force at a position where the portion of the recording sheet that protrudes from the first tray in the ejection direction is supported.

10. A sheet post-processing device for post-processing of a recording sheet ejected from an image forming device in an ejection direction, the sheet post-processing device comprising:

a first tray on which the recording sheet is placed after ejection;

a push-out member configured to push out, in a push-out direction different from the ejection direction, the recording sheet placed on the first tray; and one or more rollers disposed further downstream in the ejection direction than a position of the push-out member when the push-out member pushes the recording sheet, the one or more rollers protruding upwards from a surface on which the recording sheet is placed after ejection, wherein the one or more rollers are rotatable in the push-out direction, and reduce a resistive force that hinders the pushing out of the recording sheet when the push-out member pushes out the recording sheet, reducing the resistive force downstream in the ejection direction more than upstream in the ejection direction, the one or more rollers are disposed in a vicinity of an edge of the first tray in the ejection direction, and the one or more rollers are disposed on an upper edge of a vertical wall that the recording sheet passes over when pushed by the push-out member, the vertical wall is at a front side of the sheet post-processing device.

11. The sheet post-processing device of claim 10, further comprising:

a guide member disposed adjacent to an ejection direction downstream end of the first tray, the guide member being configured to support a portion of the recording sheet that protrudes from the first tray in the ejection direction, wherein the one or more rollers are disposed in the vicinity of the guide member.

12. The sheet post-processing device of claim 11, wherein the one or more rollers are disposed on a sheet placement surface of the guide member.

* * * * *